United States Patent [19]

Carlsson et al.

[11] 4,147,187

[45] Apr. 3, 1979

[54] SHUTTLE

[75] Inventors: Erik Carlsson; Karel Pejchal; Hans G. Fritzon; Staffan Hagstrom; Anton Kerff; Lars Wide, all of Ulricehamn, Sweden

[73] Assignees: AB IRO, Ulriceham, Sweden; Juan Amengual, Palma de Mallorca, Spain

[21] Appl. No.: 878,000

[22] Filed: Feb. 15, 1978

[30] Foreign Application Priority Data

Feb. 21, 1977 [DE] Fed. Rep. of Germany ..... 2707439

[51] Int. Cl.[2] ..... D03D 5/06

[52] U.S. Cl. ..... 139/196.2; 139/437

[58] Field of Search ..... 139/437, 438, 196.2

[56] References Cited

U.S. PATENT DOCUMENTS

| | | | |
|---|---|---|---|
| 1,632,912 | 6/1927 | Mullor et al. | 139/437 |
| 3,554,240 | 1/1971 | Sakamoto | 139/437 |

FOREIGN PATENT DOCUMENTS

| | | | |
|---|---|---|---|
| 47-24989 | 7/1972 | Japan | 139/437 |
| 516674 | 1/1972 | Switzerland | 139/196.2 |
| 412322 | 9/1974 | U.S.S.R. | 139/196.2 |

*Primary Examiner*—Henry Jaudon

*Attorney, Agent, or Firm*—James E. Nilles

[57] ABSTRACT

A weft thread carrier is disclosed for a loom with a weft thread supply at each side thereof and wherein the carrier, just before entering the shed, engages a weft thread segment that it draws into a loop while moving in the shed. Each weft thread segment extends across the carrier path obliquely to that path, from its supply through a fixed thread eye to the selvedge. The carrier has a hook projecting towards each of its ends, each capable of catching a weft thread segment, but it also has a deflecting surface for each hook, so arranged in relation to its hook that it deflects a thread segment away from the hook if the segment is at one oblique angle to the carrier path but permits the hook to engage a segment at the opposite oblique angle. Hence, as the carrier emerges from each side of the shed it merely deflects the thread segment across its path, but in moving towards the shed its then-forward hook engages the same segment.

5 Claims, 20 Drawing Figures

Figure 1:
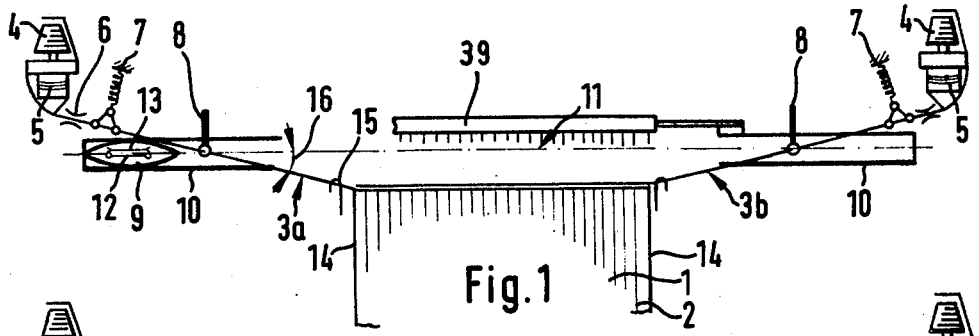

Fig.11b
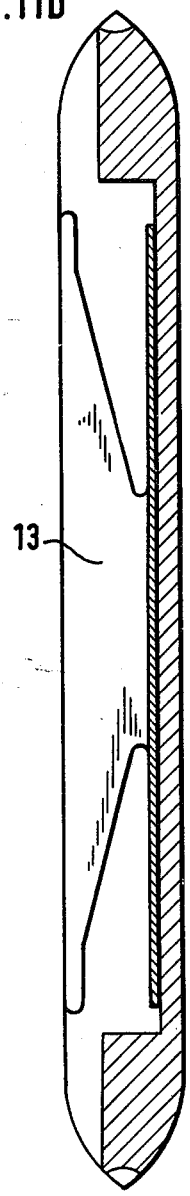
Fig.11a
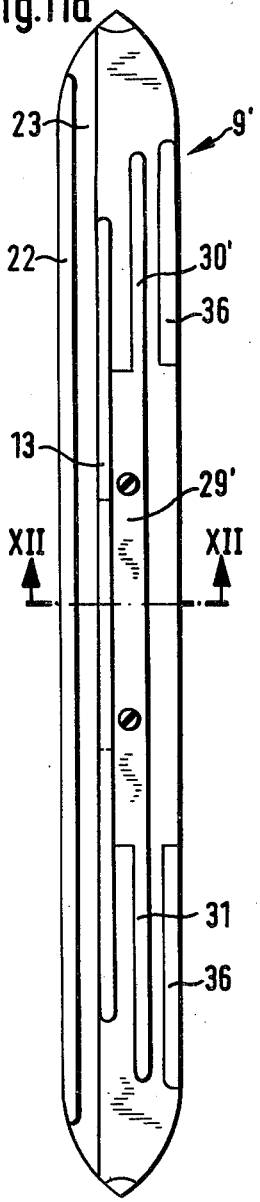
Fig.11c
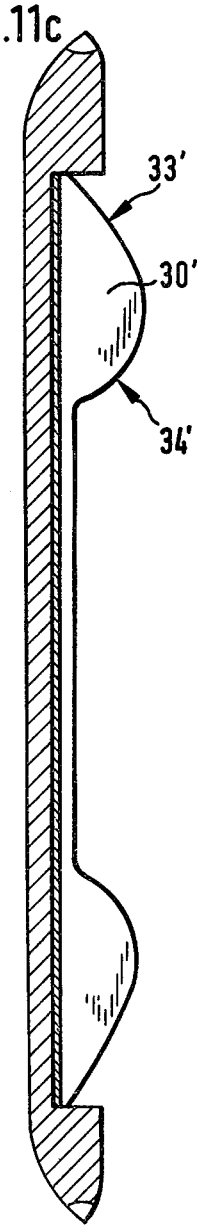
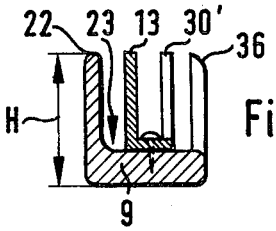
Fig.12

Fig.13a
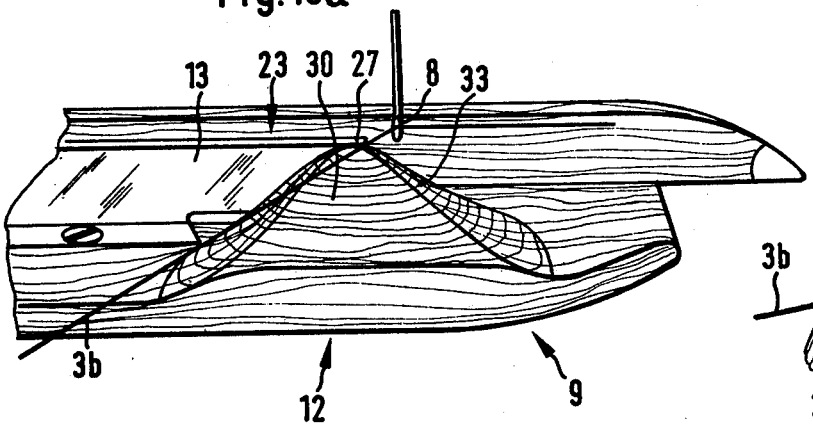
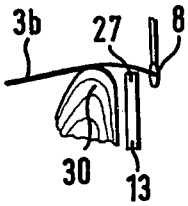
Fig.13b
Fig.14a
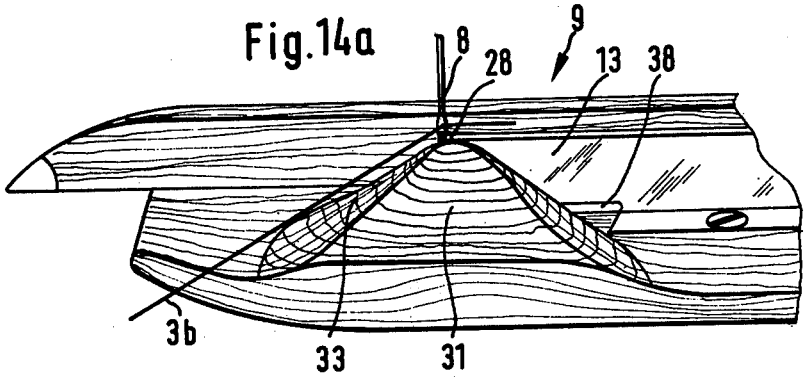
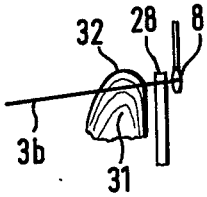
Fig. 14b

SHUTTLE

This invention relates to a loom in which the shuttle draws weft threads across the shed alternately from opposite sides of the loom, and of the type wherein the shuttle, at the beginning of each traverse or pick across the warp threads, engages a thread segment to initially form it into a loop that has one end continuous with a previously laid weft thread and its other end continuous with a thread supply, and wherein the thread segment is cut through when the shuttle reaches about the halfway point in its traverse, to separate said one end of the loop from the previously laid weft thread and to enable the shuttle to carry the thus-freed end of the loop out of the shed; and the invention is more particularly concerned with improvements in a gripper shuttle for such a loom.

In looms of the type here under consideration there is a thread supply at each side of the loom; and at the beginning of each traverse or pick, the shuttle engages a segment of thread that extends from its then-adjacent thread supply to a previously laid weft thread. As the shuttle enters the shed of warp threads, it draws that segment into a loop and during about half of its travel across the width of the loom it enlarges that loop by withdrawing thread from the thread supply. At about the halfway point in the shuttle traverse, the looped thread segment is severed from the previously laid weft thread, and at the same time a thread brake is applied to prevent further withdrawal of thread from the thread supply. The shuttle then draws the newly-freed end of the loop out of the other side of the shed and enters a shuttle box for a reversal of its picking motion. In starting its return transit across the loom from the shuttle box just mentioned, the shuttle picks up a loop of thread that is continuous with its then-adjacent thread supply, and the above described process is repeated in the reverse direction.

It will be evident that as the shuttle begins each traverse across the loom it must infallibly engage the segment of thread that it has to draw across the shed of warp threads. This means that the thread segment that is to be gripped for a picking traverse in one direction must be properly located and oriented to be gripped by the shuttle at the time in the loom cycle when the shuttle is beginning its motion in that direction. Slightly earlier, however, when the shuttle was completing its immediately preceding traverse, moving in the opposite direction, its gripping engagement with the same thread had to be prevented.

Heretofore these requirements have been met by providing a thread eye near each selvedge through which the thread from the adjacent thread supply was guided, and the thread eye was arranged to be so actuated in synchronism with the loom cycle as to carry its thread out of the path of motion of the shuttle as the shuttle was completing a picking traverse in one direction and back into the path of motion of the shuttle immediately before the shuttle started a new picking traverse in the opposite direction. An expensive control mechanism was required for actuating the thread eyes at the proper times in the loom cycle. A further and important disadvantage of an arrangement comprising such a movable thread eye was that the weft thread did not necessarily have a desired tension at the instant when it was gripped by the shuttle, and it might have an unfavorable changing geometry at that time, owing to the inability of the conventional thread tensioner to operate uniformly in response to the very rapid movements that had to be made by the thread eye. A constant thread tension and a weft thread geometry that remains uniform are both necessary if high quality fabric is to be produced with high speed operation of a loom.

U.S. Pat. No. 3,494,384 discloses a loom of the general type here under consideration wherein the thread segment that is to be carried into the shed is pressed into a groove in the gripper shuttle body by movably mounted thread eyes, so that the weft thread loop is latched onto a gripping point on the shuttle that is arranged for the direction of motion in which the thread loop is to be carried. Transfer of the weft thread to the gripper point requires complicated and expensive control of the movement of the thread eye. Furthermore, the weft thread at the opposite side of the loom, which is to be engaged during the opposite direction picking motion of the shuttle, must be maintained in a position that is out of the path of the shuttle as it moves out of the shed towards it, for otherwise the gripping point on the shuttle would engage it and draw it in the wrong direction. Consequently, the transfer of each weft thread segment and its proper movement into and out of the path of the shuttle must be accomplished with such precision that the speed of the loom cycle and the functional reliability of the loom mechanism are compromised.

German Pat. No. 476,058 discloses a loom which operates on a principle seldom employed in modern looms and which is particularly unsuited for looms of the type here under consideration. In that case, during each loom cycle a doubled weft thread in the form of a loop is introduced into the shed, so that, notwithstanding a slower loom cycle, a relatively high rate of production of finished fabric can be obtained. At each side of the loom a thread eye is arranged on a holding rod whereby the thread eye is moved towards the path of movement of the gripper shuttle as soon as the shuttle has moved out of the shuttle box and begins to move into the shed. This movable thread eye presents to a pair of gripping hooks on the gripper shuttle a loosely handing thread segment which the shuttle carries through the entire shed as a U-shaped loop. This principle affords neither a constant thread geometry nor a uniform thread tension. Nevertheless, a motion control mechanism is required for actuating the two holding rods alternately, to transfer each from its inoperative position to its operative position. In this known loom, specially designed thread pickup hooks are likewise mounted for movement appropriate to their functions, and they take over the picked weft thread from the gripper shuttle as it emerges from the shed, whereupon the thread tensioner at the opposite side of the loom is brought into operation to tighten the newly picked loop. However, the thread segment presented to the newly arrived gripper shuttle is not tensioned and hangs loose.

The present invention has for its object to so improve a loom of the character described that the weft thread gripped by the gripper shuttle remains under constant tension and maintains a constant geometry, and wherein the gripper shuttle is so formed that it can take up a weft thread to be carried into the shed without need for any actuating mechanism for changing the position or orientation of the weft thread, so that the cost of the loom is decreased and its operating speed is increased.

Another object of the invention is to provide a loom of the character described wherein each thread eye is mounted in fixed relation to the path of motion of the shuttle and extends into that path, and wherein the shuttle has at least one thread deflecting surface for each direction of its motion, which thread deflecting surface is spaced from a thread gripping element on the shuttle and is so formed and arranged that the shuttle is automatically prevented from gripping a thread that extends through the thread eye as the shuttle emerges from the shed but causes the thread to be looped around the shuttle as the shuttle moves into the shed.

It will be apparent that it is also an object of this invention to provide a loom of the character described that has no requirement for the thread eye actuating and synchronizing means heretofore considered necessary, so that a loom embodying the principles of the invention is less expensive, less complex mechanically and less susceptible to mechanical break down or failure than prior looms of the same general type but is nevertheless capable of operating reliably at high speeds.

Another specific object of the invention is to provide a loom of the character described having a gripper shuttle which is so configured as to be capable of proper automatic cooperation with fixed thread eyes, whereby the proper weft thread segment is reliably gripped by the shuttle as it moves in each direction of its traverse across the loom without requiring the presence of additional structural elements for the attainment of such cooperation, and whereby the engaged weft thread segment always has the same position and orientation and is always under the same tension at the instant that it is engaged by the shuttle, thereby insuring that the fabric woven on the loom will be of uniformly high quality even when the loom is operating at high speeds.

It is also an object of this invention, achieved by reason of the attainment of the last-stated object, to provide a loom wherein weft thread breakages and failures, which entail expensive stoppages of the weaving process, are eliminated almost completely.

A further specific object of the invention is to provide a loom of the above described character wherein the thread eyes can be fixedly secured either to the shuttle boxes or to the reed, so that the thread eyes can be established in fixed relation to the path of motion of the shuttle with the employment of simple means.

Another and very important object of the invention is to provide improvements in a known type of loom whereby the above stated objects can be attained without the need for complex or expensive modification of the loom and, in particular, without modification of shuttle boxes or actuating mechanism.

The several objects of the invention are achieved, in general, by a novel configuration of the shuttle that is described in more detail hereinafter, and is characterized by essential features which are set forth in the claims, in cooperation with thread eyes, one at each side of the loom, so disposed as to be in the path of motion of the shuttle and to maintain the respective thread segments that they guide in such positions and orientations as to make possible the proper functioning of the shuttle in either gripping or deflecting each thread segment, as may be appropriate to the prevailing direction of motion of the shuttle.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

Figure 6B:
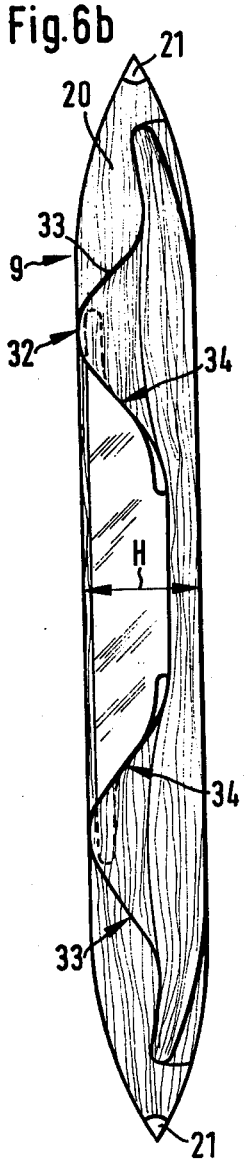
Figure 6A:
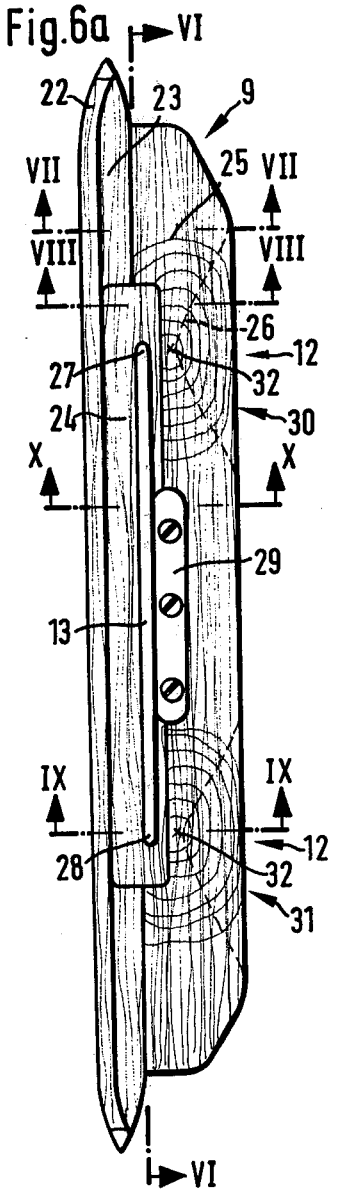

The accompanying drawings illustrate two complete examples of the embodiments of the invention constructed according to the best modes so far devised for the practical application of the principles thereof, and in which:

FIGS. 1 through 5 are more or less diagrammatic views respectively illustrating conditions at each of a succession of instants during a weaving cycle of a loom embodying the principles of this invention, but showing only the portion of the loom at which the weaving operation takes place and in which the invention is embodied;

FIG. 6*a* is a plan view of a gripper shuttle for a loom embodying the principles of this invention;

FIG. 6*b* is a side view of the gripper shuttle shown in FIG. 6*a;*

Figure 6C:
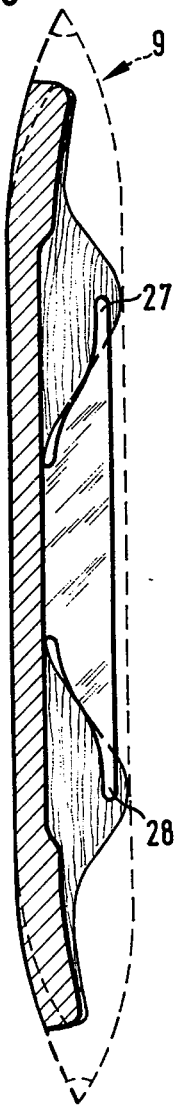
Figure 9:
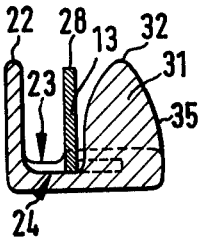

FIG. 6*c* is a view in longitudinal section taken on the plane of the line VI—VI in FIG. 6*a;*

FIGS. 7 through 10 are views in cross section, respectively taken on the plane of the lines VII—VII through X—X in FIG. 6*a;*

FIGS. 11*a* through 11*c* are views which respectively correspond to FIGS. 6*a*–6*c* but which illustrate a modified embodiment of the gripper shuttle;

FIG. 12 is a view in cross section taken on the plane of the line XII—XII in FIG. 11*a;*

FIG. 13*a* is a perspective view of the gripper shuttle illustrated in FIGS. 6*a*–10, shown as it moves out of the shed and in relation to a thread segment that it is to deflect;

FIG. 13*b* is a fragmentary view of the condition illustrated in FIG. 13*a,* as seen from in front of the gripper shuttle;

FIG. 14*a* is a view generally like FIG. 13*a* but illustrating conditions as the gripper shuttle moves into the shed and in relation to a thread segment that it is to grip; and FIG. 14*b* is a view generally similar to FIG. 13*b* but illustrating the conditions shown in FIG. 14*a.*

Referring now to the accompanying drawings, and particularly to FIGS. 1 through 5 wherein parts of the loom that are not essential to the invention have been omitted for simplicity, finished fabric 1 is woven of lengthwise extending warp threads 2 and transverse weft threads 3*a,* 3*b* that are carried across the warp threads ("picked") alternately from opposite sides of the loom. At each side of the loom, spaced outwardly from the fabric selvedge 14, there is a weft thread supply 4 that comprises a conventional thread delivery device 5. As shown, the weft thread 3*a* has been drawn from the left hand thread supply 4 and the weft thread 3*b* has been drawn from the right hand thread supply. As thread is drawn from a thread supply it passes successively through a thread brake 6 that is closely adjacent to the thread supply, a thread tensioner 7 and a thread eye 8, and thence extends to the adjacent selvedge 14.

For picking weft threads across the conventional shed formed by the warp threads 2 there is provided a gripper shuttle 9 that moves back and forth across the loom along a defined path 11 that has its terminals at shuttle boxes 10, one at each side of the loom. At the end of each traverse or pick across the loom, the gripper shuttle 9 is received in one of the shuttle boxes 10, each of which comprises conventional actuating mechanism (not shown) that propels the shuttle towards the other shuttle box at the proper time in the weaving cycle. The gripper shuttle 9 is described in more detail hereinafter, but at this point it may be observed that it comprises a pair of thread control surfaces 12, indicated only schematically in FIGS. 1–5, and a gripping member 13 that cooperates with the thread control surfaces.

Each thread eye 8 is so mounted that it at all times extends into the path of motion 11 of the gripper shuttle, but the shuttle has a longitudinal groove (described hereinafter) in which the thread eye is received with some clearance so that the shuttle can readily pass each thread eye. To dispose the thread eyes 8 in the path of shuttle motion, each thread eye can be rigidly secured to its adjacent shuttle box 10, or as will be understood by those skilled in the art, the thread eyes can be structurally united with the conventional reed 39 (FIG. 1). For each weft thread 3*a*, 3*b* there is preferably provided a holding element 15 that is located near the selvedge 14 and is arranged to engage the length of thread that extends between the selvedge and the adjacent thread eye. Each holding element 15 serves to deflect and support its weft thread as the thread is being drawn into the shed. Each holding element also cooperates with its adjacent thread eye 8 and thread tensioner 7 to maintain its thread under a uniform tension and to ensure that when the gripper shuttle 9 is in the adjacent shuttle box 10, the thread will extend across the motion path 11 of the shuttle and at a predetermined oblique angle 16 to that path as explained hereinafter.

The operation of a loom embodying the invention will now be described so that the functions of the various parts of the gripper shuttle 9 can be more readily understood during the subsequent detailed description of the shuttle.

In FIG. 1 the gripper shuttle 9 is shown just after having completed a picking traverse from right to left by which it drew the weft thread 3*b* through the shed, and that weft thread has been beat up against the fell of the fabric 1 by means of the reed 39 (FIG. 1) which has returned to its normal position out of the way of the path of shuttle motion. During the beating up and return movement of the reed the direction of motion of the shuttle 9 is reversed.

Upon beginning its new (left to right) motion into the shed, the gripper shuttle takes up the weft thread 3*a* from the thread eye 8 by means of its gripping member 13. The shuttle carries the thread into the shed in the form of a U-shaped loop that is connected at one end with the left-hand thread supply 4 and has its other end connected with a weft thread picked in the previous left-to-right traverse. The segment of thread that connects the loop carried by the gripper shuttle with the previously picked weft thread may be deflected at the selvedge, or, if a deflecting hook 15 is provided, it will be deflected around that hook as denoted by the broken line 16″ in FIG. 2.

Figure 3:
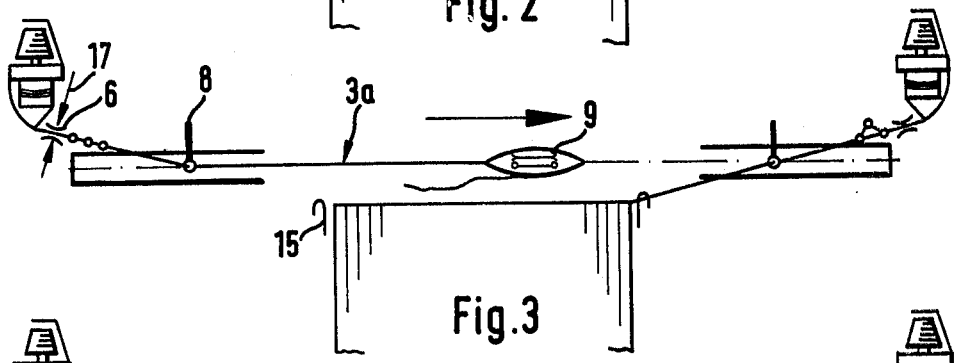
Figure 4:
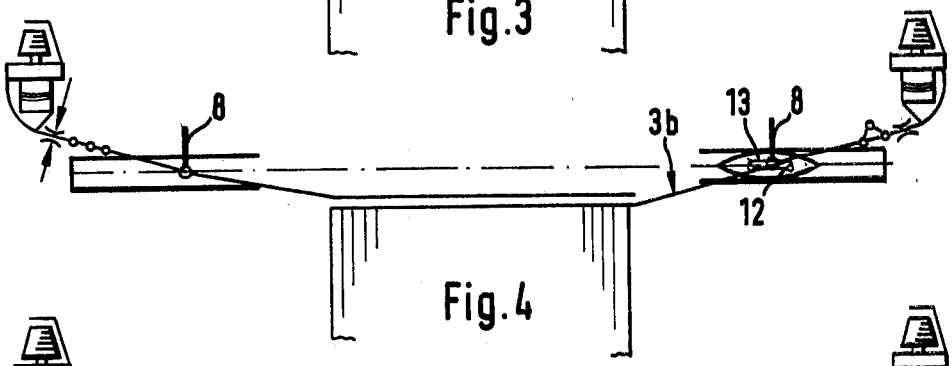

When the gripper shuttle reaches a point about halfway across the loom, a cutting impulse is issued to a cutting device (not shown) to cause the loop of thread carried by the shuttle to be severed from the previously picked weft thread. The cut is made either at the left selvedge or at the left holding element 15. Simultaneously with that cutting, the left thread brake 6 is applied, as symbolized by the arrow 17, to prevent further thread from being drawn out of the left thread supply 4. See FIG. 3. As the shuttle continues its motion to the right, the newly-freed end of the thread loop that it carries is drawn out to the right-hand selvedge and is there released by the shuttle as the shuttle continues its motion past that selvedge. Meanwhile, the stationary thread eye 8 in the right shuttle box 10 holds the weft thread 3*b*, but the gripper shuttle cannot grip that thread by reason of its thread control surfaces 12, as more fully explained hereinafter. The gripper shuttle thus moves to its reversing position in the right shuttle box, as illustrated in FIG. 4.

Figure 2:
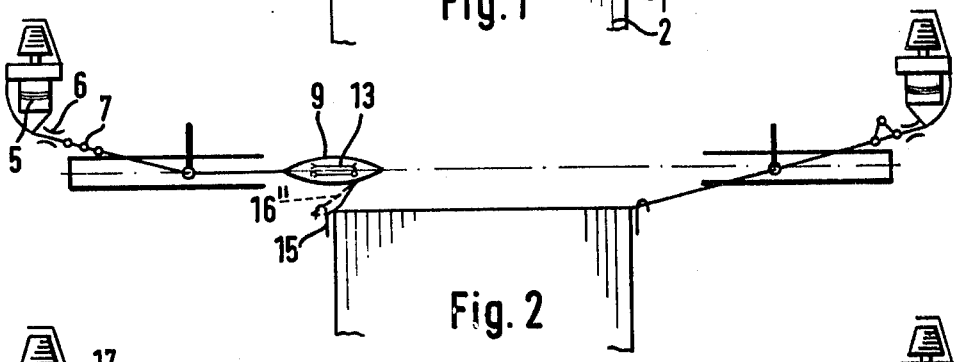
Figure 5:
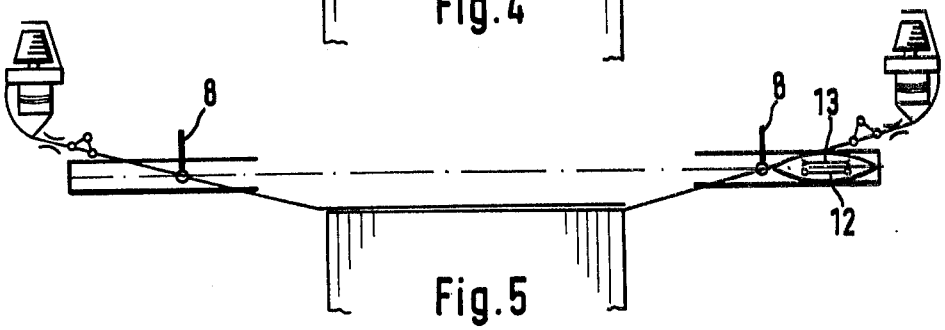

The direction of motion of the gripper shuttle is reversed in the right-hand shuttle box 10 while the reed (not shown), operating in a conventional manner, beats up the weft thread 3*a* and returns to its normal position. Conditions are now as illustrated in FIG. 5. As the shuttle moves to the left out of the right-hand shuttle box 10 and towards the shed, it takes up the weft thread 3*b* from the right thread eye 8, and the process illustrated in FIGS. 2 and 3 is repeated, but near the right-hand selvedge and with the shuttle moving to the left.

In consequence of the cooperation of the thread control surfaces 12 on the shuttle with the thread geometry established by the stationary thread eyes 8 and the holding elements 15, there is obtained a reliable weft thread picking as the shuttle moves alternately from opposite sides of the loom, although the need for special control mechanism is eliminated by the thread control surfaces 12, which allow the gripper shuttle to grip the respective weft threads only upon entry of the shuttle into the shed and prevent the occurence of such gripping as the shuttle moves out of the shed.

Details of the gripper shuttle 9 are more clearly seen in FIGS. 6*a*–6*c*, taken with the sectional views, FIG. 7–10.

Attention is directed to the fact that the gripper shuttle 9 is in all respects fore-and-aft symmetrical, that is, one lengthwise extending half of the shuttle is a mirror image of the other one.

Figure 7:
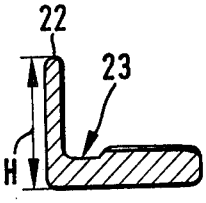
Figure 8:
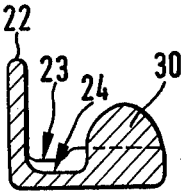

The gripper shuttle 9 comprises a body 20 having a basically L-shaped cross-section (FIG. 7). An upright leg of the L has its longitudinally extending upper edge chamfered to provide a guide edge 22 which defines the height H of the body. Near the ends of the body its upright leg tapers into pointed end portions 21 on the body that have conventional protective sheathing.

Figure 10:
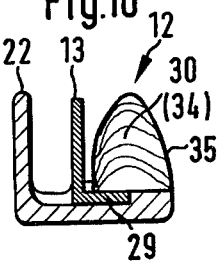

Mounted on the laterally projecting leg of the L-shaped shuttle body 20 is the gripping member 13, which is elongated lengthwise of the shuttle body and also has an L-shaped cross-section, as best seen in FIG. 10. The gripping member can be made of sheet metal. A laterally projecting leg 29 of the L-shaped gripping member, which serves to fix the gripping member to the shuttle body, flatwise overlies the laterally projecting leg of the shuttle body and is secured thereto as by means of screws. An upright leg of the gripping member 13 is spaced from and parallel to the upright leg of the L-shaped shuttle body and defines therewith a groove 23 that extends substantially the full length of the shuttle. The groove 23, in which each thread eye 8 is received as the shuttle passes it, is deepened and widened through the central portion of the shuttle to form a trough 24 (see FIG. 8). It will be understood that the narrower portions of the groove 23 are wide enough to allow the shuttle to pass the thread eyes 8 without contacting them.

As viewed from the side of the shuttle, and as best seen in FIG. 6*c*, the upright leg of the gripping member 13 is substantially longer at its top than at its bottom, and its end portions curve upwardly and lengthwise outwardly to terminate in endwise oppositely projecting gripping hooks 27, 28, each of which points away from the mid-point of shuttle length. As can be seen from FIG. 6*b*, and also from FIG. 6*c*, the straight upper edge of the upright leg of the gripping member, which extends parallel to the chamfered guiding edge 22 on the shuttle body, is at a level slightly below that of said chamfered edge.

At this point it will be apparent that a thread extending generally across the path of shuttle motion, and at a level a little below that of the two gripping hooks 27, 28, can be caught by whichever of the gripping hooks is pointing in the direction of shuttle motion; and as the shuttle continues its motion after such initial engagement, the thread will be deflected downwardly and rearwardly along the adjacent inclined lower edge of the gripping member 13 to be securely confined beneath the gripping member. To enable each thread to be located at the level for such capture by one of the gripping hooks 27, 28, the thread eye 8 through which the thread extends must be so mounted and arranged as to project down into the longitudinal groove 23.

From the partial description of the shuttle that has been presented to this point, it will be apparent that, without more, one of the gripping hooks 27, 28 would be capable of engaging a thread in each direction of lengthwise motion of the shuttle. But proper operation of the loom imposes the complicated and rather paradoxical requirement that the particular gripping hook which points in the direction of shuttle motion must catch a thread that is presented to it as the shuttle is leaving the shuttle box and is about to enter the shed, but must nevertheless be prevented from engaging a thread which extends across its path at the other side of the loom and which it passes just after leaving the shed.

This requirement is fully satisfied in the shuttle of the present invention by the technically simple expedient of providing a pair of mound-like thread control surfaces 12 on the shuttle body that are spaced from one another along its length, each arranged for cooperation with one of the gripping hooks 27, 28. The thread control surfaces 12 are located at the side of the gripping member 13 that is remote from the chamfered guide surface 22, and they rise from the laterally extending leg of the L-shaped shuttle body 20, near its outer longitudinal edge.

To facilitate an understanding of the configuration and functioning of the thread control surfaces, mention should now be made of the fact that each of the thread segments extending across the path of shuttle motion must be oriented at a proper oblique angle to the direction of shuttle motion, in addition to being at a proper level relative to the gripping hooks 27, 28 as described above. Specifically, a thread that is to be hooked must extend away from its thread eye 8 and across the path of the gripping hooks 27, 28 at a forwardly oblique angle to the direction in which the shuttle is moving when capture is to occur; but a thread that is not to be captured must extend away from its thread eye and across the path of the hooks at a rearwardly oblique angle to the direction of shuttle motion. The threads 3*a*, 3*b* at opposite sides of the loom will have their segments that extend across the path 11 of shuttle motion disposed at opposite oblique angles to that path, and consequently, for each direction of shuttle motion one of those thread segments (the one nearest the shuttle box 10 from which the shuttle is departing) will be so oriented that it can be caught by the forwardly projecting gripping hook 27 or 28, whereas the thread segment at the other side of the loom will be so oriented as to be deflected away from the same gripping hook by the thread control surface 12 that is laterally adjacent to said gripping hook.

To provide for such thread deflection, each thread control surface 12 has a leading flank 33 which faces obliquely upwardly and towards its adjacent end of the shuttle, and that flank is located wholly in front of the forwardly projecting tip of the laterally adjacent gripping hook 27, 28, as best seen in FIG. 6*b*. Each forward flank 33 rises rather gradually in a convex curve to a crest 32 which is above the level of the laterally adjacent gripping hook 27, 28 and is preferably at the same level as the chamfered guiding edge 22. The crest 32 of each thread control surface curvingly merges into a downwardly and rearwardly inclined rear flank 34. The lower termini of the rear flanks 34 are spaced apart along the length of the shuttle by a distance slightly greater than the length of the lower edge of the upright leg of the gripping member 13.

In the embodiment of the invention illustrated in FIGS. 6*a*–10, each of the deflecting surfaces 12 also has a side flank 35 that curves downwardly from its crest 32 and laterally in the direction away from the gripping member 13. These side flanks 35 serve for warp thread deflection, as explained hereinafter. The side flank 35 of each thread control surface 12 is convexly rounded into its front flank 33, its rear flank 33 and its crest 32, so that the thread control surface 12 as a whole is knoll-like, having contours such as are suggested by the contour lines 25 in FIG. 6*a*.

For purposes of example let it be assumed that the shuttle 9 is moving downwardly as shown in FIG. 6*a* so that its gripping hook 28 can be regarded as its front gripping hook. A thread segment that is to be caught by the hook 28 must therefore extend obliquely downwardly and to the right across the path of the hook 28. In that case the portion of the thread segment that is to the right of the gripping hook 28 will extend across the low portion of the front flank 33 on the front thread control surface 31, and the hook 28 can pass over the thread and cam it down along the lower front edge of the gripping member 13 as the shuttle continues its forward motion, as illustrated in FIGS. 14*a* and 14*b*. The thread will be some distance down along that lower edge as it passes in contact with the crest 32 of the front thread control surface 31, and thereafter it will ride down the rear flank 34, as well as moving farther down the lower edge of the gripping member 13.

It will be apparent that the rear flank 34 of the front thread control member will then cooperate with the lower edge of the gripping member 13 to substantially confine the thread against upward displacement along the lower edge of the gripping member.

If the shuttle is moving upwardly as shown in FIG. 6*a*, a thread segment oriented as just described (downwardly to the right) will not be caught by the hook 27 because the thread will be engaged and lifted by the front flank 33 of the front thread control surface 30 and will be deflected up along that flank, reaching the crest 32 at about the time that the hook 27 passes it. The thread is thus held at a level above the hook 27 and clear of it, as illustrated in FIGS. 13*a* and 13*b*. With continuing motion of the shuttle, the thread will ride down the rear flank 34 until it rests upon the straight upper edge of the gripping member 13.

At high loom speeds and with short loom cycles it is not always possible to avoid having the shuttle come into contact with warp threads as the shuttle nears the end of a picking traverse across the shed, with the result that the shuttle motion is disturbed and the weft thread being picked across the shed is improperly placed. The side flanks 35 of the thread control surfaces 12 serve to deflect such possibly interfering warp threads away from the shuttle and thereby prevent them from influencing the placement of weft threads.

In the modified form of shuttle 9' of this invention that is illustrated in FIGS. 11*a*–12, the shuttle body is again substantially L-shaped in cross section and has an upright leg with a chamfered longitudinally extending upper guiding edge 22. Opposite its upright leg the body has warp thread deflecting surfaces 36 that are formed as upstanding wall sections (see FIGS. 11*a* and 12), and these can be integral with the remainder of the body so that the body is substantially channel shaped in cross-section along the portions thereof in which these wall sections are present. The gripping member 13 is similar to that of the above described embodiment and is thus again L-shaped in cross-section with its laterally projecting leg 29' providing for securement to the body and its upstanding leg providing the gripping element proper and defining gripping hooks that project away from one another and towards the ends of the body. The gripping member 13 is again in laterally spaced relation to the upright leg of the body to define therewith the longitudinal groove 23 in which the thread eyes are received.

In this embodiment, however, the thread control surfaces 30' can be formed integrally with the gripping member as flat lobes that project up from the lateral leg 29' of the basically L-shaped gripping member, in spaced, parallel relation to the gripping element proper. The front flank 33' of each thread control surface is inclined upwardly and rearwardly at a rather shallow angle (see FIG. 11*c*) and is convexly curved to a rounded apex which is substantially at the level H of the chamfered edge 22 and which in turn merges around a convex curve into a relatively steeply inclined rear flank 34'. As can be seen from FIG. 12, the thread control surfaces 30' rise to substantially the height H of the chamfered thread guiding edge 22, while the upper edge of the gripping member 13, which is located between the chamfered edge 22 and the thread control surfaces 30', has its upper edge at a slightly lower level.

The embodiment of the gripper shuttle that is illustrated in FIGS. 11*a*–12 can be very sturdy but can nevertheless be made easily and inexpensively inasmuch as its body can be of wood or plastic and the warp thread deflecting portions can be formed integrally with it.

In order to put the principles of this invention into practice, certain significant parameters must have a proper relationship to one another. Of special significance is the location of each thread eye 8 in relation to its adjacent holding element 15—or, if no holding element is provided, in relation to the adjacent selvedge—since that relationship establishes the angle between the path of motion of the shuttle and the thread segment which extends across that path and thus controls the capability of the shuttle for either taking up or deflectingly passing the thread as occasion demands. Insofar as this thread orientation may vary during the loom cycle, it need only be considered at the time that the shuttle is moving in its picking transit, but it must be considered in relation to the height level of the thread eye relative to the shuttle body and the form and position of the thread control surfaces.

Experience has shown that the angle 16 (see FIG. 1) between the shuttle path 11 and the thread segment extending thereacross should be about 15° for successful operation. With this thread geometry good results have been obtained with the crest 32 of the thread control surfaces 30, 31 spaced about 10 mm. laterally from the gripping hooks 27, 28 and with the gripping hooks about 5 mm. below the level of the crests. The thread eye 8 dips a further 5 mm. below the level defined by the gripping hooks 27, 28. These relationships have been successful in a gripper shuttle for a loom wherein the shuttle boxes were synchronized with the movement of the reed and in which the shuttle moved through the shed along the lower reed frame.

Of course the angle 16 could have some other value than 15°, but in that case it would be necessary to adjust the form of the thread control surfaces and the height and lateral spacing of the several elements on the shuttle in accordance with the requirements imposed by the angle selected. The necessary adjustments could be most readily made by experiment.

Although the invention has been described for purposes of example in its application to a gripper shuttle, it will be understood that its principles can also be applied to a rod-type weft thread carrier, which can be provided with a gripping element and thread control surfaces like those described above, for taking up or deflectingly passing threads extending through thread eyes which would be stationary.

From the foregoing description taken with the accompanying drawings it will be apparent that this invention provides improvements in a loom having a shuttle or other weft thread carrier that moves across the shed alternately from opposite sides of the loom, whereby the loom mechanism is simplified and made less expensive than heretofore but whereby greater assurance is nevertheless obtained that weft threads will be properly laid.

Those skilled in the art will appreciate that the invention can be embodied in forms other than as herein disclosed for purposes of illustration.

The invention is defined by the following claims.

We claim:

1. In a loom having a thread supply at each side thereof from which weft threads are drawn alternately by a weft thread carrier confined to back and forth motion across the loom, wherein said carrier, in moving away from each side of the loom, takes up a thread segment that is connected with the thread supply at that side of the loom and with a previously laid weft thread and draws said thread segment into a U-shaped loop, and wherein said thread segment is severed from said previously laid weft thread when said carrier is about halfway across the loom so that the end of the loop freed by the severing can be drawn to the other side of the loom, the improvement which is characterized by:

A. a pair of elongated thread gripping hooks fixed on the weft thread carrier,
   (1) each of said hooks having a front end portion which is remote from the front end portion of the other,
   (2) said hooks being aligned with one another and spaced apart in the direction of carrier motion and having their said front end portions at a common level, and
   (3) each of said hooks having a lower surface which is inclined downwardly from said level and rearwardly away from its front end portion;

B. a pair of thread eyes, one at each side of the loom, through each of which thread from the thread supply at its side of the loom extends for supporting guidance, each of said thread eyes being, (1) at a fixed location that is adjacent to the path along which said thread gripping hooks are carried during shuttle motion, to be at one side of said hooks as they pass the thread eye, (2) below said level, and (3) so disposed in relation to other means on the loom by which the thread through the thread eye is supported that a length of said thread extends away from the thread eye obliquely across the path of the thread gripping hooks at a level below said common level of the thread gripping hooks and at an inclination towards the other side of the loom; and C. said weft thread carrier having thread control means thereon providing a weft thread deflecting surface for each thread gripping hook, said thread control means (1) being spaced to the opposite side of said thread gripping hooks and (2) rising from substantially below said level so that there is a substantially deep slot between each of said hooks and the thread control means, and (3) each weft thread deflecting surface having a rearwardly and upwardly inclined front flank which is spaced forwardly of the front end of its thread gripping hook and which rises to above said level, whereby a thread length extending from a thread eye and across the paths of said thread gripping hooks and said thread control means at a rearward inclination to the direction of weft thread carrier motion is deflected upwardly past said hook but a thread length extending from a thread eye and across said paths at a forward inclination to said direction of motion is permitted to be engaged by said hook.

2. The loom of claim 1, further characterized by: each weft thread deflecting surface also having (1) a rearwardly and downwardly inclined rear flank and (2) a crest portion which is rounded into said front flank and said rear flank and which is above said common level of the thread gripping hooks.

3. The loom of claim 2 wherein said rear flank is more steeply inclined than said front flank.

4. The loom of claim 2, further characterized by: said weft thread carrier further having a warp thread deflecting surface spaced farther to said opposite side of each deflecting hook and which is convexly rounded to bulge away from the deflecting hook.

5. The loom of claim 4 wherein each of said warp thread deflecting surfaces is on a mound-like deflector that also provides the weft thread deflecting surface for a thread gripping hook, and the warp thread deflecting surface curvingly merges into the front and rear flanks and the crest portion of the weft thread deflecting surface.

* * * * *